US009670685B2

(12) United States Patent
Landry

(10) Patent No.: US 9,670,685 B2
(45) Date of Patent: Jun. 6, 2017

(54) REMOVABLE ANCHORING DEVICE FOR PITCHED ROOFING

(71) Applicant: Sécurité Landry Inc., Laval (CA)

(72) Inventor: Daniel Landry, Terrebonne (CA)

( * ) Notice: Subject to any disclaimer, the term of this patent is extended or adjusted under 35 U.S.C. 154(b) by 0 days.

(21) Appl. No.: 14/987,797

(22) Filed: Jan. 5, 2016

(65) Prior Publication Data

US 2016/0194890 A1 Jul. 7, 2016

Related U.S. Application Data

(60) Provisional application No. 62/100,530, filed on Jan. 7, 2015.

(51) Int. Cl.

| | |
|---|---|
| ***E04G 21/00*** | (2006.01) |
| ***E04G 21/32*** | (2006.01) |
| ***A62B 35/00*** | (2006.01) |

(52) U.S. Cl.

CPC ..... *E04G 21/3276* (2013.01); *A62B 35/0068* (2013.01)

(58) Field of Classification Search

CPC ..... E04G 21/3276; E04G 21/3295; E04G 21/3261; E04G 21/3223; A62B 35/0068

USPC ..... 248/237; 182/3, 45, 113

See application file for complete search history.

(56) References Cited

U.S. PATENT DOCUMENTS

| | | | | |
|---|---|---|---|---|
| 5,067,586 | A * | 11/1991 | Myers | E04G 21/3214 182/113 |
| 5,730,246 | A * | 3/1998 | Beard | E04G 21/3261 182/3 |
| 6,112,853 | A * | 9/2000 | Beard | E04D 15/00 182/3 |
| 6,382,894 | B2 * | 5/2002 | Goodding | E04D 13/158 414/11 |
| 7,806,232 | B2 * | 10/2010 | Thomas | E04G 21/3223 182/113 |
| 2010/0108442 | A1 * | 5/2010 | Ballantyne | E04G 21/3261 182/129 |
| 2011/0239580 | A1 * | 10/2011 | Rodewald | A62B 35/0068 52/699 |
| 2012/0312633 | A1 * | 12/2012 | Massey | A62B 35/0068 182/3 |
| 2013/0228394 | A1 * | 9/2013 | Sousa | A62B 35/0068 182/3 |

* cited by examiner

*Primary Examiner* — Anita M King
(74) *Attorney, Agent, or Firm* — Agence de Brevets Fournier; Claude Fournier

(57) ABSTRACT

A removable anchoring device for a pitched roof comprises a clamping device that is removably mountable onto the edge of a first slope of the roof and a flexible attachment secured to the clamping device for attaching the worker to the clamping device for work on or below a second slope that is opposite to the first slope. According to an illustrative embodiment, the removable anchoring device comprises a frame, first and second clamping members mounted to the frame for contacting respectively first and second surfaces of the roof near an edge of a first slope thereof. The first and second clamping members are so mounted to the frame for selective variation and locking of the position and angle of the first clamping member relative to the second clamping member.

10 Claims, 5 Drawing Sheets

REMOVABLE ANCHORING DEVICE FOR PITCHED ROOFING

CROSS REFERENCE TO RELATED PATENT APPLICATION

This application claims the benefit of U.S. Provisional Application No. 62/100,530, filed on Jan. 7, 2015, the content of which is incorporated by reference herein.

FIELD

The present disclosure relates to safety devices for people working at heights such as roofers, bricklayers, electricians and more generally construction workers. More specifically, the present disclosure relates to a removable anchoring device for pitched roofing to be used by such people.

BACKGROUND

Construction works are high-risk activities when they are performed at heights and more specifically when they involve performing precise and tedious tasks using tools and materials. Falls usually result in deaths and serious injuries.

Known methods for securing a worker on a pitched roof include securing a slide guard using roof brackets and/or fastening an anchor to the roof, which is then used to attach the worker using conventional harness and lanyard.

A drawback to these solutions is that they involve permanently mounting equipment to the roof, which can cause damages to the roof structure, in addition to the additional risks and costs involve in their installation.

SUMMARY

The drawbacks of permanently securing for workers an anchor to a pitched roof are solved by removably mounting a clamping device onto the edge of a first slope of the roof and by attaching the worker to the clamping device using a rope or the like for work on a second slope that is opposite to the first slope.

According to an illustrative embodiment, there is provided a removable anchoring device for a pitched roof comprising:

a frame;

a first clamping member mounted to the frame for contacting a first surface of the roof near an edge of a first slope thereof;

a second clamping member mounted to the frame for contacting a second surface of the roof near the edge thereof; and the first and second clamping members being so mounted to the frame for selective variation and locking of both the position and angle of the first clamping member relative to the second clamping member.

According to another illustrative embodiment, there is provided a removable anchoring device for a worker on a pitched roof comprising a clamping device that is removably mountable onto the edge of a first slope of the roof and a flexible attachment secured to the clamping device for attaching the worker to the clamping device for work on or below a second slope that is opposite to the first slope.

According to still another illustrative embodiment, there is provided a method for temporarily anchoring a worker on a pitched roof comprising:

clamping an anchoring device onto the edge of a first slope of the roof;

attaching the worker to the anchoring device using a flexible attachment, for work on or below a second slope that is opposite to the first slope.

Examples of people working on a pitched roof that would benefit from using an anchoring device as illustrated herewith include, without limitations, slaters, chimney sweep, and construction workers.

Other objects, advantages and features of the anchoring device and method for temporarily anchoring a worker on a pitched roof will become more apparent upon reading the following non-restrictive description of preferred embodiments thereof, given by way of example only with reference to the accompanying drawings.

DETAILED DESCRIPTION

Figure 1:
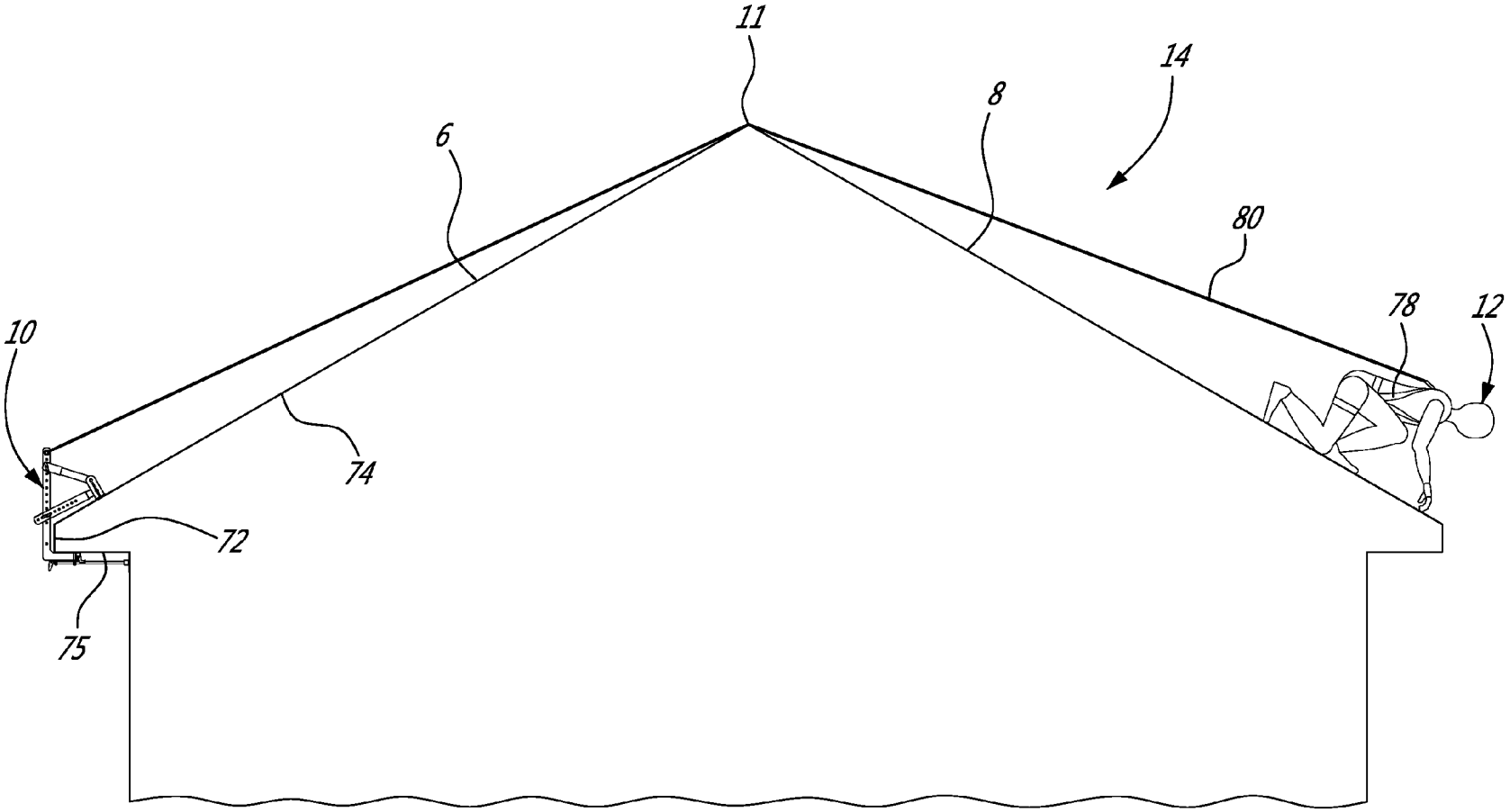
FIG. 1 is a partly schematic side elevation of a pitched roof provided with a removable anchoring device for a person working on the roof according to a first illustrated embodiment.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

Figure 4:
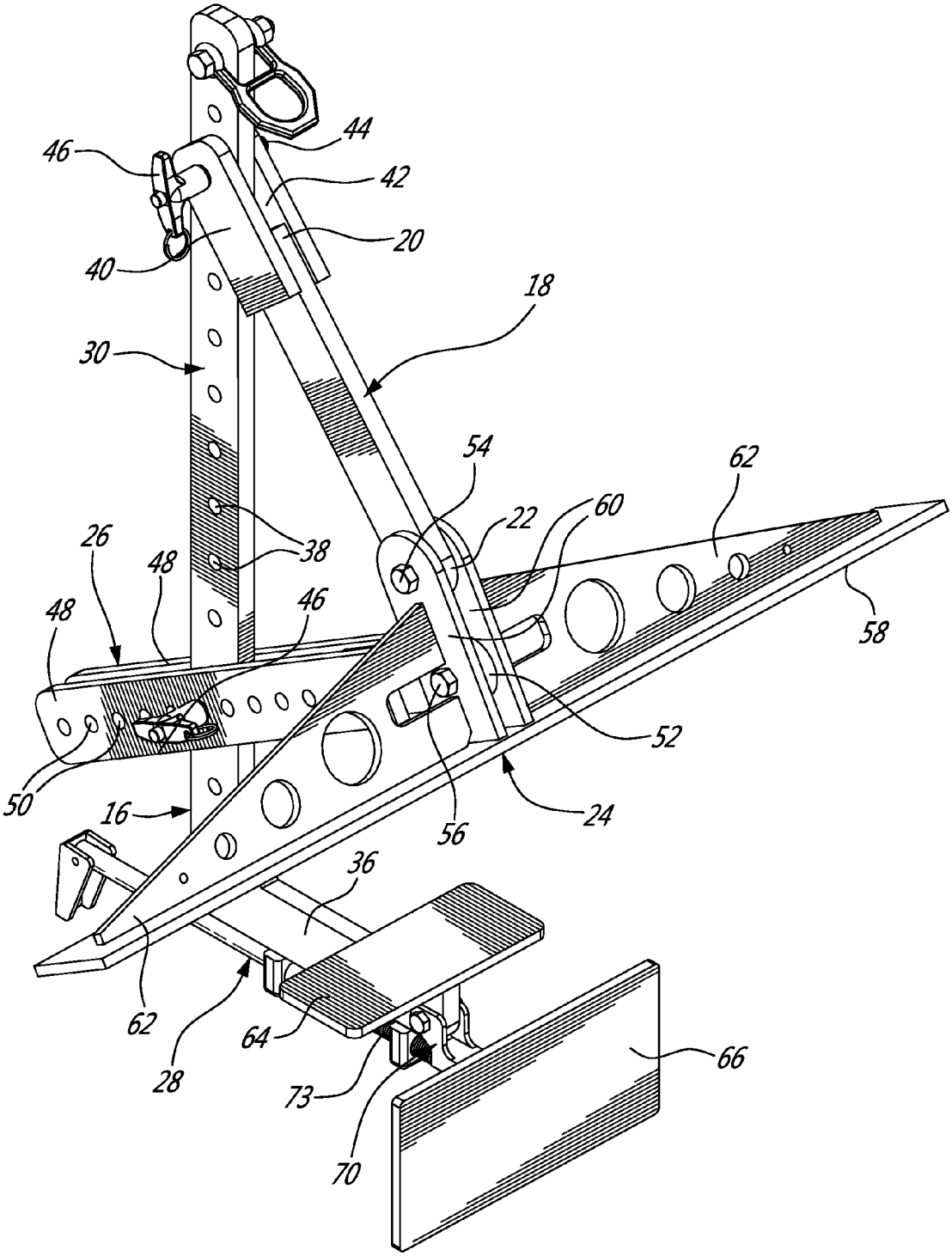
FIG. 4 is a perspective of the anchoring device from FIG. 1.

A removable anchoring device 10 for a worker 12 on a pitched roof 14 according to a first illustrated embodiment will now be described with reference to FIGS. 1-2 and 4.

Even though the anchoring device 10 is illustrated herein with reference to a roofer 12, it can be used for other people working at heights such as bricklayers, electricians, rope access specialists, siding and gutters installers and more generally construction workers.

Figure 2:
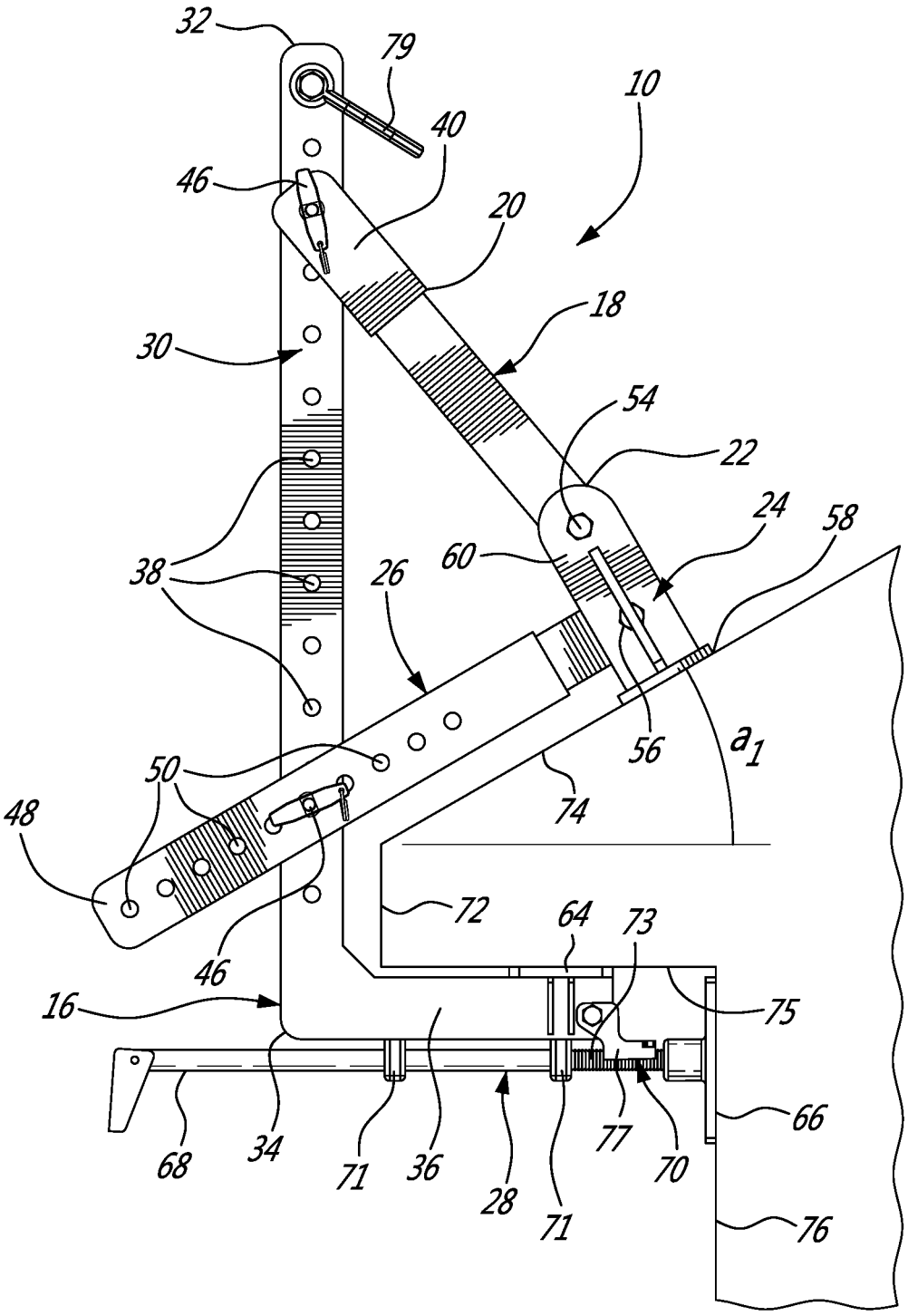
FIG. 2 is a close up side elevation of the anchoring device from FIG. 1; the configuration of the device being adjusted for mounting to a roof having a first angle.

As shown in FIG. 1, the anchoring device 10 is mounted to the edge 72 of a first slope 6 of the roof 14 by clamping thereto and is used with a flexible attachment 80 that is secured to the device 10 at one end, and to the worker 12 at the other end thereof. The anchoring device 10 allows the worker 12 safe displacement and work on a second slope 8 that is opposite to the first slope 6 relative to the crest 11 of the roof 14.

The removable anchoring device 10 comprises an L-shaped frame 16, a first lever arm 18 having first and second longitudinal ends 20 and 22 and being pivotally mounted to the L-shaped mounting member 16 at its first longitudinal end 20, a first contact plate assembly 24 pivotally mounted at the second longitudinal end 22 of the first lever 18, a second lever arm 26 mounted to both the L-shaped mounting member 16 and the contact plate assembly 24 therebetween, a second contact plate 64 and an adjustable locking assembly 28 mounted to the L-shaped member 16. Each of these components 16-28, and 64 of the removable anchoring device 10 will now be described in more details.

The L-shaped frame 16 includes a first arm 30 provided with first and second longitudinal ends 32-34 and a second relatively shorter arm 36 extending perpendicularly from the first arm 30 at the second longitudinal end thereof 34. The longer arm 30 is provided with longitudinally distanced apertures 38.

As will be described hereinbelow in more detail, the L-shaped member 16 allows receiving the first and second levers 18 and 26 and positioning one relative to the other to allow the configuration of the removable anchoring device 10 to be adapted to the configuration and angle of the roof 14.

As can be seen in FIG. 1, the contact plate assembly 24 and contact plate 64 define first and second clamping members that are relatively moved to contact respective top and bottom surfaces 74 and 75 of the roof 14 near the edge 72.

The first lever 18 is in the form of a flat rod that is pivotally mounted to the longer arm 30 of the L-shaped mounting member 16 via a pair of plates 40 that are secured to the lever 18 at the first longitudinal end thereof 20 using for example welding. The plates 40 define a slot 42 that receives the longer arm 30 of the frame 16. The plates 40 are provided with registered apertures (not shown) for receiving a fastener 44 that pivotally attaches the plates 40 to the arm 30 in one of the apertures 38 near the longitudinal end 32 thereof. A handle nut 46 is provided for securing the fastener 44 in the apertures.

According to another embodiment (not shown), the arm 30 includes two parallel and distanced flat members that define a slot for pivotally receiving the lever 18. According to this embodiment, the plates 40 are omitted.

Other assemblies (not shown) can be used to pivotally mount the lever 18 to the arm 30. According to another embodiment (not shown), the lever 18 is pivotally mounted to the arm 30 in a non-removable fashion, wherein the longitudinal position of the pivotal mounting of the lever 18 to the arm 30 is fixed.

The second lever 26 is defined by two flat rods 48 that are assembled in a parallel relationship by their mounting to the longer arm 30 of the L-shaped mounting member 16 on respective lateral sides thereof.

The rods 48 are provided with longitudinally distanced registered apertures 50, any pair of which can be used for their pivotally mounting to the arm 30 via a fastener (not shown). A handle nut 46 is provided for securing the fastener in the selected apertures 50.

The positions of the apertures 38 and 50 on respectively the arm 30 and rods 50 are such as to yield a discrete set of possible angles between the contact plate assemblies 24 and 64 as well as relative positions therebetween. For example, the removable anchoring device 10 can then be adapted to an angled roof 14 having an angle 'a1' by configuring the device 10 so as to substantially position the plate 58 of the plate assembly 24 parallel to the roof surface 74.

Both lever arms 18 and 26 are pivotally mounted via their distal ends 22 and 52 to the contact plate assembly 24 via fasteners 54 and 56 respectively. The pivotability of the plate assembly 24 further contributes to the adaptability of the anchor device 10 to different pitches of roofs.

The contact plate assembly 24 includes an elongated plate 58 that is fixedly mounted to two (2) small parallel plates 60 perpendicularly thereto. The two plates 60 are distanced to define a slot for receiving both levers 18 and 26 therein and include apertures for receiving the fasteners 54 and 56. A pair of triangular-shaped rigidity plates 62 are secured to the plate 58 and to each plate 60 therebetween. The plate 58 defines a first contact plate.

According to the first illustrative embodiment, the length of the plate 58 is such that it contacts the roof 14 over a length sufficient to cover at least two consecutive trusses (not shown) thereof so as to distribute thereon the load applied on the device 10. While it has been found that a wider plate 58 results in more stability of the device 10, a narrower or longer plate can also be provided.

A second contact plate 64 secured to the smaller arm 36 at the distal end thereof using welding or a mounting bracket (not shown).

The adjustable locking assembly 28 includes a third contact plate 66 mounted to the shorter arm 36 of the L-shaped member 16 so as to be slidable thereunder along an axis generally parallel thereto.

More specifically, the plate 66 is secured at the distal end of a thin rod 68 generally perpendicularly thereto. The rod 68 is slidably mounted to the arm 36 via collars 71 to be in a general parallel relationship with the arm 36.

A spring-loaded locking mechanism 70 is provided between the arm 36 and rod 68 that allows selectively locking the position of the plate 66 relative to the arm 36. More specifically, the rod 68 is provided with small annular groove 73 that are engaged by a hook element 77 of the mechanism 70. The element 77 is pivotally mounted to the arm 36 at the distal end thereof. A leaf spring (not shown) is secured to both the hook element 77 and to the arm 36 for biasing the hook element 77 towards the rod 68. The hook element 77 is unengaged from the rod 68 by its pivoting upwardly.

Other mechanisms than those illustrated can be provided to change and lock the position of the plate assembly 66 relative to the arm 36.

In operation of the anchoring device 10, the levers 18 and 26 are positioned relative to the longer arm 30 of the L-shaped mounting member 16 so that the contact plate 24 generally defines the angle 'a1' of the roof 14 with the shorter arm 36.

To maximize the stability of the removable anchoring device 10, it is then moved as close as possible to the edge 72 of the roof 14 on one of the slope side 6 while the plate 58 contacts the roof top surface 74 and the plate 64 contacts the roof bottom surface 64. The contact plate 66 is then put in an abutment position with the building wall 76 under the roof 14 and locked in place.

Depending for example on the pitch of the roof 14, it can be easier to fixed and lock the position of one or both of the levers 18 and 26 relative to the frame 16 after the plate 64 is in contact with the lower surface 75 of the roof 14.

A user 12 provided for example with a harness 78 can then secure himself to the device 10 by attaching one end of a cable 80 to his harness 78 and the other end thereof to the device 10, for example to a single point anchor 79 secured to the longer arm 30 near the distal end 32 thereof. The user 12 can then safely work on the slope side of the roof 14 which is opposite to the one to which the device 10 is removably secured.

As a person skilled in the art will now appreciate, the user pulling on the rope 80 increases the securing force of the device 10 to the opposite edge of the roof 14.

Since the pad assembly 24 is mounted to the frame 16 using two lever arms 18 and 26, its position is automatically locked by the length of the arms 18 and 26 and their mounting positions onto the frame 16.

Of course, to prevent the user 12 from falling when attached to the device 10, the length of the rope or cable 80 is less than the combined width of both roof slopes.

In some application, the use of a sufficiently long cable 80 may also allow the user to work below the roof 14, for example while standing on scaffolding.

Figure 3:
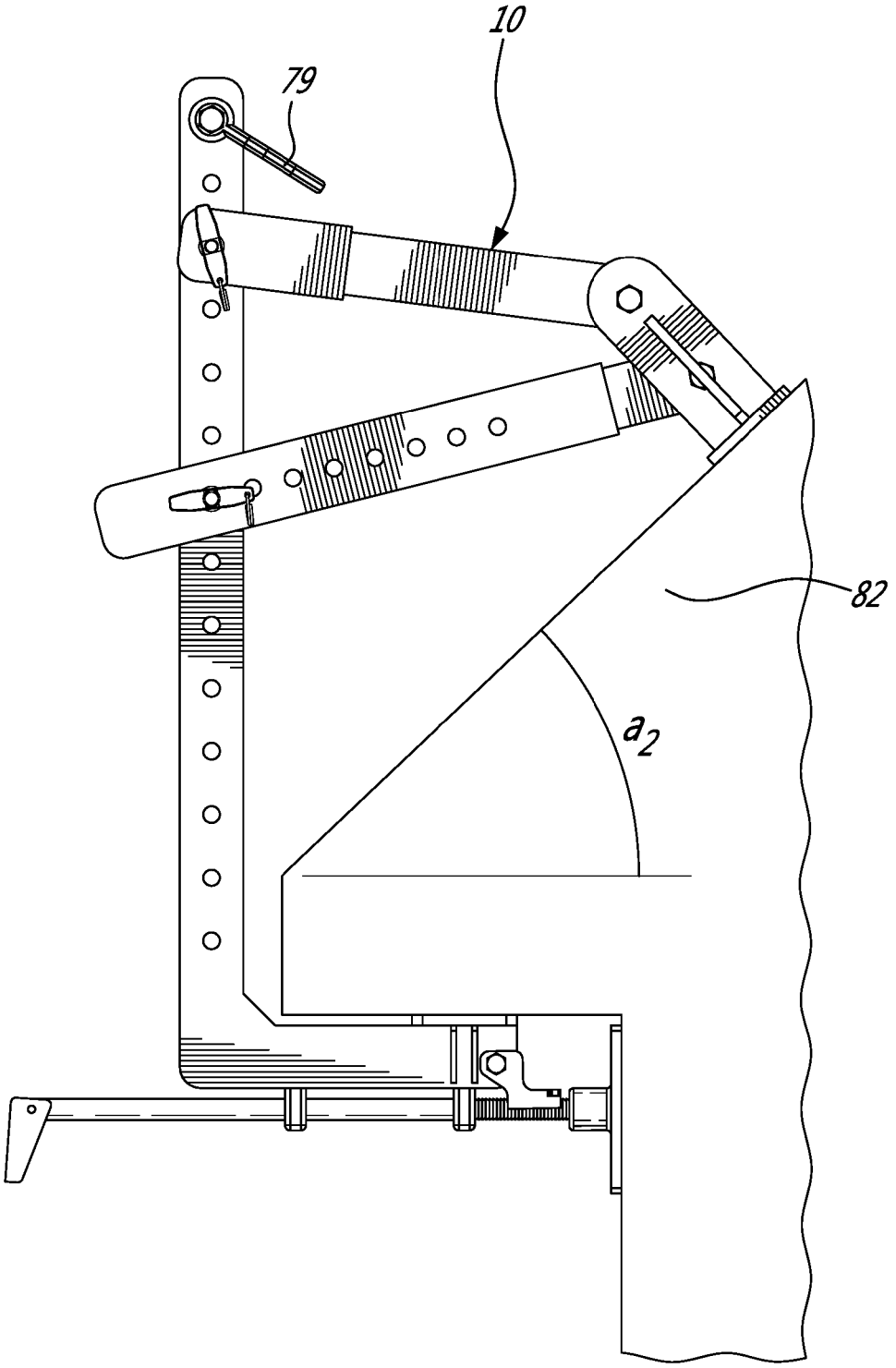
FIG. 3 is a close up side elevation of the anchoring device from FIG. 1; the configuration of the device being adjusted for mounting to a roof having a second angle.

As can be seen in FIG. 3 and as described hereinabove, the configuration of the anchoring device 10 can be modified for its removable mounting to an angled roof 82 having another slope 'a2'.

The anchoring device 10 can be used with other safety equipment than a harness 78, and other methods and devices than a single point anchor 79 can be used to attach the user 12 to the device 10 via a cable or else.

Any flexible attachment can be used to secure the user 12 to the anchoring device 10, including a cable, a chain, a lanyard, etc.

Figure 5:
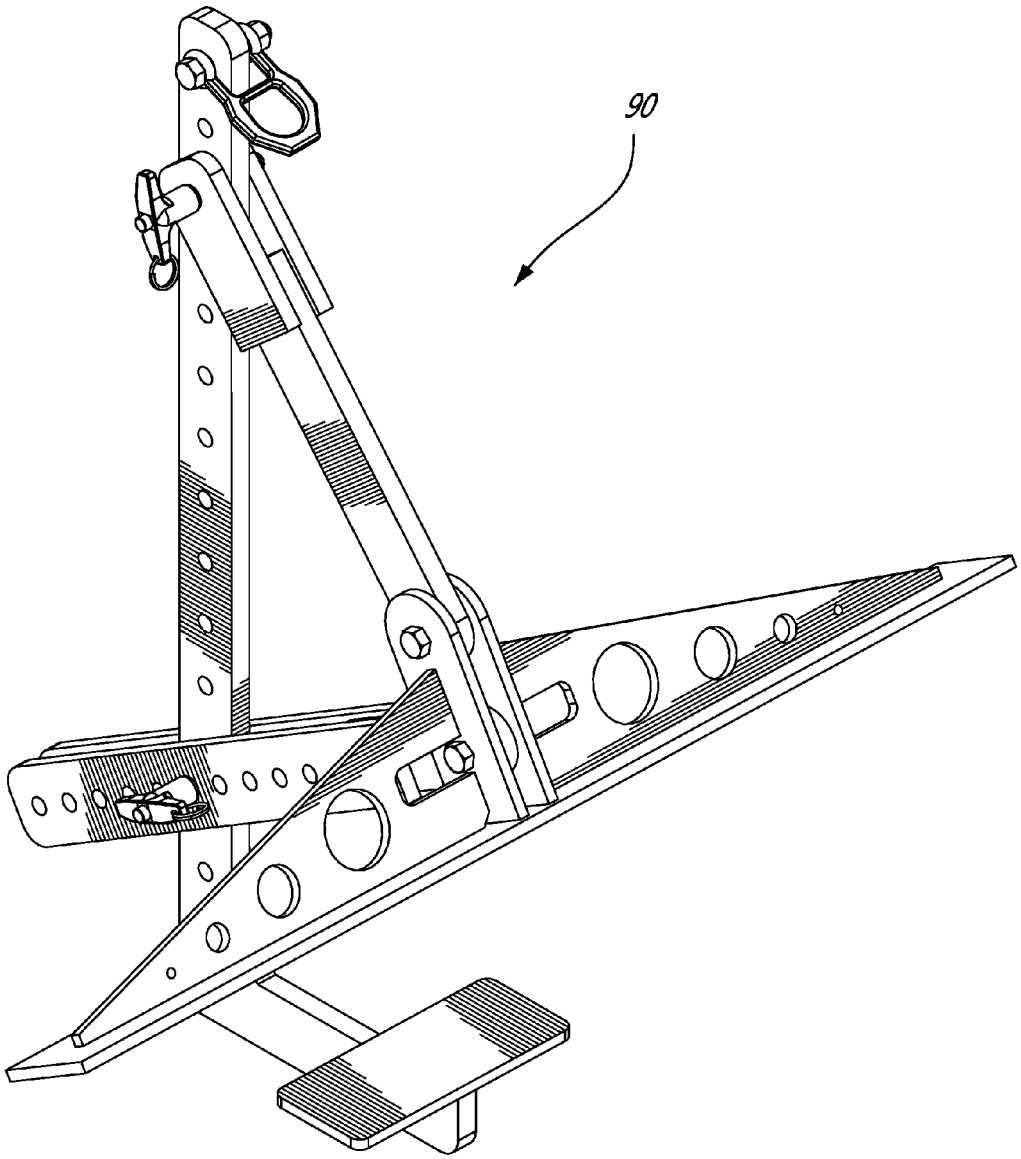
FIG. 5 is a perspective of a removable anchoring device for a worker on angled roof according to a second illustrative embodiment.

FIG. 5 shows a removable anchoring device 90 for a pitched roof according to a second illustrated embodiment. Since the device 90 is similar to the device 10, only the difference therebetween will be described herein for concision purposes.

In the device 90, the adjustable locking mechanism 28 is omitted. Indeed, it has been found that the resulting configuration of such an anchoring device 90 is sufficient to yield a safe anchor in normal use.

It is to be noted that many other modifications could be made to the anchoring devices described hereinabove and illustrated in the appended drawings. For example:

- a frame or frame assembly having a different configuration than the frame 16 can be provided to support and relatively position the contact plates 58 and 64. For example, the frame is not limited to be one-piece or L-shaped;
- additional or differently configured, sized and shaped contact elements or plate assemblies than the plates 24, 64 and 66 can be provided. More generally, members provided with a generally flat contact surface can be used for contacting onto the roof surfaces;
- the position of the pivotal mounting of one or both of the lever arms 18 and 26 to the frame 16 can be fixed;
- one of the two levers 18 and 26 can be replaced by a mechanism or device mounted to both the frame 16 and remaining lever 18 or 26 therebetween that biases the remaining lever 18 or 26 towards the surface 74 of the roof or locks the position of such lever relative to the frame 16. Examples of such biasing mechanism or device include a small piston or a locking-mechanism similar to the locking mechanism 70;
- the length of any one of the arms 30 and 36 can be made adjustable using any method and element known in the art;
- well-known ratchet elements can be provided between any pair of elements of the anchoring device so as to adjustably lock their relative positions.

Although the anchoring device has been described hereinabove by way of illustrated embodiments thereof, it can be modified. It is therefore to be understood that numerous modifications may be made to the illustrative embodiments and that the scope of the claims should not be limited by the preferred embodiment, but should be given the broadest interpretation consistent with the description as a whole.

What is claimed is:

1. A removable anchoring device for a pitched roof, comprising:

a frame;

a first clamping member mounted to the frame for contacting a first surface of the roof near an edge of a first slope thereof;

a second clamping member mounted to the frame for contacting a second surface of the roof near the edge thereof; and the first and second clamping members being so mounted to the frame for selective variation and locking of both the position and angle of the first clamping member relative to the second clamping member;

wherein the first and second clamping members include respective first and second contact elements for contacting the first and second surfaces respectively;

wherein the first clamping member includes first and second lever arms both pivotally secured to the frame at respective first and second distanced positions thereon and both pivotally mounted to the first contact element.

2. The removable anchoring device of claim 1, wherein the first and second lever arms are both pivotally mounted to the first contact element via a mounting assembly.

3. The removable anchoring device of claim 2, wherein the mounting assembly includes a slot for pivotally receiving the first and second lever arms; the first contact element being secured to the mounting assembly so as to be positioned generally perpendicular to the slot.

4. The removable anchoring device of claim 2, wherein the frame is L-shaped; the first and second lever arms being mounted to a first arm of the frame; the second clamping member being secured to a second arm of the frame.

5. The removable anchoring device of claim 4, wherein the first arm of the frame includes a plurality of longitudinally distanced lever arm-receiving positions for selectively receiving the first and second lever arms.

6. The removable anchoring device of claim 5, wherein the plurality of longitudinally distanced lever arm-receiving positions are apertures in the first arm.

7. The removable anchoring device of claim 6, wherein at least one of the first and second lever arms includes longitudinally distanced fastener-receiving apertures for selectively mounting the at least one of the first and second lever arms to the first arm of the frame.

8. The removable anchoring device of claim 4, further comprising an adjustable locking assembly secured to the second arm of the frame; the adjustable locking assembly including a third contact element for contacting a structure under the roof; the third contact element being slidable relative to the second arm of the frame therealong so as to allow movement of the third contact element towards and away the structure when the anchoring device is clamped to the pitched roof; the adjustable locking assembly further including a locking mechanism for locking a position of the contact element relative to the second arm.

9. The removable anchoring device of claim 8, wherein the third contact element is slidably mounted to the second arm via a rod that includes annular grooves; the locking mechanism including a hook element pivotally mounted to the second arm of the frame and biased towards the rod for cooperating with at least one of the grooves for selectively preventing the movement of the third contact element towards and away the third surface structure under the roof.

10. A removable anchoring device for a pitched roof, comprising:

a frame;

a first clamping member mounted to the frame for contacting a first surface of the roof near an edge of a first slope thereof;

a second clamping member mounted to the frame for contacting a second surface of the roof near the edge thereof; and the first and second clamping members being so mounted to the frame for selective variation and locking of both the position and angle of the first clamping member relative to the second clamping member;

wherein the first and second clamping members include respective first and second contact elements for contacting the first and second surfaces respectively;

wherein the first clamping member includes a first lever arm pivotally secured to the frame and to the first contact plate therebetween and a locking element for locking the position and angle of the first lever arm relative to the frame.

* * * * *